US007134923B1

(12) United States Patent
Leach et al.

(10) Patent No.: US 7,134,923 B1
(45) Date of Patent: Nov. 14, 2006

(54) RETRACTABLE RUDDER ASSEMBLY FOR A WATERCRAFT

(76) Inventors: Peter M. Leach, 1068 Tustin Pine Way, Tustin, CA (US) 92780; Janis Lin Leach, 1068 Tustin Pines Way, Tustin, CA (US) 92780

( * ) Notice: Subject to any disclaimer, the term of this patent is extended or adjusted under 35 U.S.C. 154(b) by 9 days.

(21) Appl. No.: 11/042,102

(22) Filed: Jan. 26, 2005

(51) Int. Cl.
*B63H 11/117* (2006.01)

(52) U.S. Cl. ..... 440/43

(58) Field of Classification Search ..... 440/43
See application file for complete search history.

(56) References Cited

U.S. PATENT DOCUMENTS

| | | | | |
|---|---|---|---|---|
| 5,362,269 | A | 11/1994 | Leach | |
| 6,086,437 | A * | 7/2000 | Murray | 440/43 |
| 6,302,047 | B1 * | 10/2001 | Cannon | 114/164 |
| 6,336,834 | B1 * | 1/2002 | Nedderman et al. | 440/43 |
| 6,443,785 | B1 * | 9/2002 | Swartz et al. | 440/40 |
| 6,652,333 | B1 * | 11/2003 | Adomeit | 440/43 |

* cited by examiner

*Primary Examiner*—Stephen Avila
(74) *Attorney, Agent, or Firm*—Chris Papageorge

(57) ABSTRACT

The assembly includes a nozzle adapter rotatably mounted via a pair of axles onto a jet nozzle of a personal watercraft. A hinge rotatably connects a rudder and cap onto the nozzle adapter. A torsion spring on the hinge retracts and retains the rudder and cap in a position in which the rudder extends below the nozzle and nozzle adapter thereby positioning the rudder in the water below the watercraft to provide steering capability to the watercraft. The cap covers and blocks the nozzle outlet when the engine is not operative but when the engine is operative the jet stream forces thereof acting against the cap rotate the rudder upwardly so that it extends rearwardly from the watercraft and out of its steering position. The nozzle adapter includes an inner adapter attached to the nozzle and an outer adapter attached to the inner adapter. A steering structure on the inner member enables horizontal rotation thereof to laterally steer the watercraft, and a trim structure on the outer member enables vertical rotation thereof to trim the watercraft.

24 Claims, 5 Drawing Sheets

RETRACTABLE RUDDER ASSEMBLY FOR A WATERCRAFT

BACKGROUND OF THE INVENTION

The present invention relates generally to jet-powered sport boats designed for use by a single person and, more particularly, to component accessories for such boats which improve their safety, stability and maneuverability.

Jet-powered watercraft have become increasingly popular over the years due in part to their maneuverability and the sensation of freedom they impart to their users. The typical jet-powered watercraft includes a water jet power assembly mounted in the hull of the watercraft. The power assembly includes an impeller or the like which propels a water stream from the nozzle of the engine to propel the craft. The nozzle is pivoted and laterally movable via linkage connected to handlebars on the watercraft enabling the operator to laterally direct the water jet stream and thereby the direction of thrust. This enables the operator to alter the direction of movement of the watercraft by rotation of the handlebars. Thus, the water jet stream serves to both propel the watercraft as well steer the watercraft.

The popularity of such watercraft has increased despite the hazards and dangers such watercraft present to the users as well as others nearby. The primary danger such watercraft present is because of the limitation that steering capability is provided solely by the jet stream from the engine. Alteration of the direction of the jet stream flow from the watercraft is provided by means of appropriate steering linkage connected to the engine nozzle. However, when the engine is off, there is no steering capability for the watercraft. Thus, when the user is coasting in to shore in order to dock the boat and thus in shallow water where swimmers are likely present, the user has no effective means of deftly steering the boat away from the swimmers. Collisions with swimmers under these circumstances are not uncommon resulting in such watercraft being banned from many beaches. In addition, engine failure or malfunction can result in complete loss of steering capability resulting in collisions with swimmers, other watercraft, docks, breakwaters, etc. with potentially disastrous results.

The handlebars of jet skis typically have a spring biased throttle control so that in the event the user falls off the vehicle the engine speed reduces to idle terminating propulsion provided to the vehicle allowing the vehicle to glide to a stop. The handlebars also typically include an electric on-off switch enabling the engine to be turned on and off quickly and easily.

When operating any type of conventional vehicle whether a personal watercraft, automobile, truck etc., a typical reaction to an impending collision is to brake the vehicle and/or ease off the throttle. But, although turning off the throttle is an effective way to deal with an impending collision situation with some other types of vehicles such as, for example, an automobile, such a natural and automatic reaction to an impending collision to a user of a jet-powered watercraft eliminates the steering capability of the watercraft. This consequently puts the user in a situation in which he has no control over the direction of movement of the watercraft. Thus, turning off the throttle to avert a collision with a dock, swimmer, shore line etc. makes a collision more likely.

Typical jet-powered watercraft hull designs provide relatively low hydrodynamic drag. Consequently, when the throttle is shut off, the inertia of the watercraft can allow the watercraft to continue to move through the water for a long time and for a long distance. Thus, the watercraft can move for a long time and long distance and sometimes at a high speed without the user being able to steer the watercraft. Collisions with other persons and obstacles in the water are not uncommon.

Some prior art designs have addressed these dangers presented by watercraft design by providing add-on rudders to the watercraft. Some of these designs have positioned the rudders behind the main body of the watercraft. Although such placement provides reasonably effective steering capability, it also adds a structure which is not readily visible and extending out from the main body and thus likely to present an obstacle. Thus, some such designs are deemed hazardous and have been banned. Similarly, some rudder designs which fix the rudders below the main body of the watercraft are also deemed hazardous and have been banned.

Some prior art auxiliary steering mechanisms have positioned a rudder below the nozzle of the engine. The rudder is spring biased which allows the rudder to move up when it strikes something in the water. Although such auxiliary steering mechanisms provide a desired degree of steering capability to the watercraft they also introduce a significant amount of drag which is always present whether or not the engine is on and producing thrust. The rudder also presents lateral drag preventing lateral movement or skimming of the watercraft over the water surface. By compromising the skimming feature, such rudder mechanisms tend to make the watercraft more likely to capsize.

Conventional personal watercraft in which the user sits upright have a high center of gravity which makes them prone to capsizing. They also have lower maneuverability in comparison to personal watercraft in which the user lies prone thereon. Consequently, such watercraft are relatively more hazardous when the engine is off particularly in rough waters.

Recognizing the dangers of such personal watercraft, some prior art accessories for such watercraft have been designed which provide steering capabilities thereto in the event the engine is off. One such type of design is disclosed in U.S. Pat. No. 6,086,437 to Murray. The Murray invention is a rudder, cap and steering linkage assembly which mounts onto the nozzle end of a jet ski engine. A spring pulls the rudder down so that it is below and behind the jet ski main body. In this position, the rudder effectively steers the craft when actuated by steering linkage which laterally rotates the entire nozzle end assembly. Murray's invention utilizes a cap which covers the nozzle outlet. The jet stream force impinging on the cap when the engine is operative pushes the cap and rudder connected thereto up and out of the water environment and into the jet stream where it is relatively ineffective in steering the watercraft. The Murray invention effectively addresses the inherent dangers of jet-powered watercraft which rely on engine operation to steer the watercraft. However, the Murray design disadvantageously adds excessive bulk to the watercraft. In addition, this bulk is below and behind the watercraft and thus positioned where it is likely to hit or get hit by someone or something. Consequently, such designs present new hazards.

Other types of jet-powered watercraft accessories utilize the jet stream force to actuate a retractable rudder. Such an accessory is disclosed in U.S. Pat. No. 6,302,047 to Cannon. As with the Murray assembly, the Cannon assembly provides steering capability only when the throttle is in the off position or when the engine is off. The Cannon rudder is mounted on a rotatable shaft positioned in the exhaust nozzle. In one embodiment the rudder is positioned next to the nozzle while in another embodiment the rudder is positioned below the nozzle. However, as with the Murray design, the Cannon design positions the rudder away from the main body of the watercraft where it can likely hit or get hit by someone or something in the water. Consequently, although the Cannon design resolves some dangers in operation of jet-powered watercraft, it introduces new dangers as well.

Some designers of jet skis have sought to improve the safety of such watercraft by providing brakes thereon. An example of such a jet ski design is disclosed in U.S. Pat. No. 5,092,260 to Mardikian. The Mardikian patent illustrates a rotatable braking structure which is positioned underneath the hull of the craft. The braking structure is basically a flap mounted on the undersurface of the hull which is manually operated. When manually rotated into position, the flap deflects water to produce the braking effect. However, this design introduces lateral drag to the craft that may detract from its desirable lateral skimming features thereby making it more likely to capsize under some circumstances. The Mardikian patent also shows another embodiment featuring braking pads on the rotating shaft of the engine. This uses reduction of engine propulsion to produce a braking effect. This invention thus effectively improves the safety of the jet ski design. Nevertheless, steering capability is still needed before the braking systems can bring the watercraft to a complete stop.

What is therefore needed is an add-on steering component accessory for a jet-powered watercraft which enables steering thereof in engine off or throttle off conditions for improved safe use thereof. What is also needed is an improved steering component accessory for a jet-powered watercraft which does not compromise the hydrodynamic attributes of the watercraft. Such an improved steering component accessory is needed which does not detract from the smooth structure and compact size and shape of the watercraft so as not to present an obstacle in use of the watercraft.

SUMMARY OF THE INVENTION

It is a principal object of the present invention to provide an assembly which may be installed on a watercraft to provide enhanced safety in use of the watercraft.

It is another object of the present invention to provide an assembly for a jet-powered watercraft which provides steering capabilities thereto during off throttle operation thereof.

It is also an object of the present invention to provide an assembly for a jet-powered watercraft which provides steering capabilities thereto during engine off operation thereof.

It is an object of the present invention to provide a steering assembly for a jet-powered watercraft which utilizes the steering mechanism used to conventionally steer the watercraft via nozzle orientation alteration.

It is an object of the present invention to provide a steering assembly for a jet-powered watercraft which is trouble free and reliable in operation.

It is an object of the present invention to provide a steering assembly for a jet-powered watercraft which enables the watercraft movement to be trimmed to enhance stability and maneuverability of the watercraft.

It is an object of the present invention to provide a steering assembly for a jet-powered watercraft which does not compromise the streamlining of the watercraft.

It is an object of the present invention to provide a steering assembly for a jet-powered watercraft which does not extend rearwardly beyond the watercraft stern.

It is an object of the present invention to provide a steering assembly for a jet-powered watercraft which does not extend below the watercraft ride plate when the watercraft is under engine propulsion.

It is an object of the present invention to provide a steering assembly for a jet-powered watercraft which may be relatively easily installed on a watercraft.

It is an object of the present invention to provide a steering assembly for a jet-powered watercraft which does not compromise the hydrodynamics of the watercraft.

It is an object of the present invention to provide a steering assembly for a jet-powered watercraft which does not compromise the performance characteristics of the watercraft.

Essentially, the steering assembly of the present invention is specifically designed to allow a user to steer a jet-powered watercraft while the watercraft is not under engine propulsion. The steering assembly is specifically designed to add this capability to a watercraft while still retaining the desired maneuverability characteristics of the watercraft. This added capability enhances the safe operation of the watercraft without in any other way detracting from other safety characteristics of the watercraft. The objective of providing steering capability is accomplished by incorporation of a rudder which is spring biased to automatically rotate it down so that it is properly positioned to laterally deflect water thereby enabling it to be used for steering of the watercraft when the engine is not providing propulsion. But, when the watercraft is under engine propulsion, the jet stream produced by the engine causes the rudder to be rotated up and out of the water and thus not positioned to steer the watercraft. The assembly includes a cap which generally covers and blocks egress of the jet stream from the engine nozzle. The cap is held in position by the spring, but the force of the jet stream impinging on the cap overcomes the spring force so as to rotate the cap and rudder up out of the water when the throttle is opened sufficiently to propel the watercraft.

The steering assembly has guide structures which enable smooth operation of the rudder and its associated parts to enhance reliable operation of the assembly. Unlike prior art rudders which are fixed, the rudder of the present invention is rotatable and yielding. The rotatable rudder in combination with the spring biasing thereof enables the rudder to move back or down and thereby prevent damage when coming in contact with a person, an object or a prominent feature of the underwater terrain.

A primary shortcoming of conventional steering systems for jet-powered watercraft is that rudder components thereof undesirably protrude from the rear of the main body of the watercraft. Thus, a primary advantage of the present invention is that it includes a shroud for the rudder so that it does not undesirably protrude from the rear of the watercraft. Another shortcoming of conventional systems for jet-powered watercraft is that rudder components thereof undesirably protrude from the bottom of the watercraft. Therefore, a primary advantage of the present invention is that the rudder is rotated out from under the watercraft when not needed for steering the watercraft.

The objective of preventing protrusion of the rudder from the watercraft is accomplished by enclosing most of the rudder in the shroud which attaches to the nozzle of the engine and in effect adapts the nozzle to receive the rotatable rudder and other component structures of the assembly of the invention. The nozzle adapter/shroud is provided with a slot and a groove within which the rudder rotates up and down. The nozzle adapter covers the lateral sides of the rudder throughout its range of movement. Only the lower portion of the rudder is exposed and it is only this lower portion that is needed to deflect water to thereby provide steering capability. The medial portion of the rudder is in the area of the jet stream (when the engine is providing propulsion) where it cannot effectively provide steering capability. Moreover, since the rudder is thin and planar and its edge faces the direction of jet stream flow, it does not block or otherwise significantly interfere with jet stream flow. Also, when the rudder is in the up position while the engine is providing propulsion, the rudder is at the top of the nozzle adapter and thus not positioned to exert a significant lateral drag which would otherwise prevent lateral movement (skimming) of the watercraft. Moreover, most of the lateral flat portion of the rudder is covered by the nozzle adapter so that this flat portion therefore cannot present an impediment to lateral movement of the watercraft. Thus, the assembly preserves rather than compromises the desirable skimming feature of such watercraft while adding a desirable maneuverability feature to the watercraft while not under propulsion. Unlike prior art rudder structures, the assembly of the invention enhances the safety as well as the performance of the watercraft.

An important shortcoming of conventional jet-powered watercraft is that they lack trimming capability and thus lack the ability to normalize the inclination of the watercraft when under propulsion. Lack of trim capability can adversely affect the performance characteristics of the watercraft making it less maneuverable or lowering its maximum speed capability. In addition, if the inclination angle is too high, the watercraft is unstable. The assembly of the invention overcomes this shortcoming by providing a nozzle adapter component that is vertically rotatable relative to the nozzle of the watercraft. In conjunction with suitable linkage connected to the nozzle adapter component, the user can direct the jet stream up or down as desired to adjust the vertical component of the thrust provided by the watercraft engine. Thus, the unique nozzle structure of the invention adds trim capability to the watercraft thereby substantially enhancing its performance characteristics.

DETAILED DESCRIPTION OF THE PREFERRED EMBODIMENT

Figure 1:
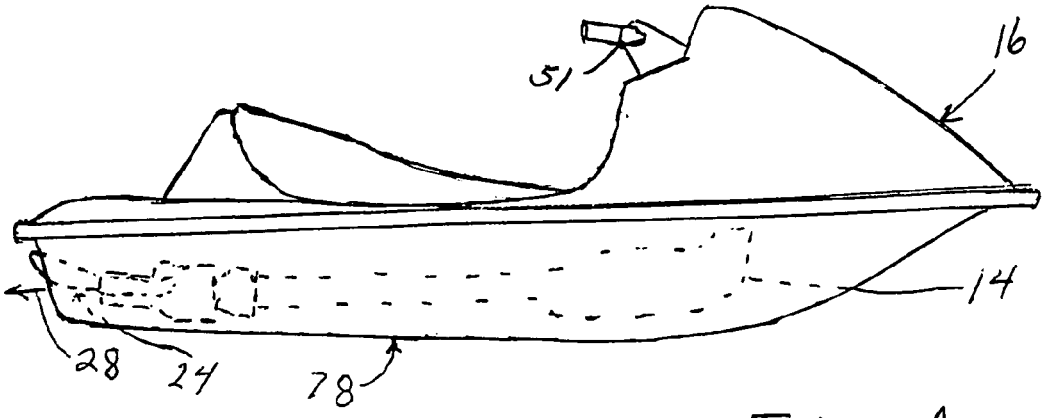
FIG. 1 is an elevational view of the rudder assembly of the invention shown mounted on a personal jet-powered watercraft and depicting the rudder of the assembly in the steering mode.
Figure 2:
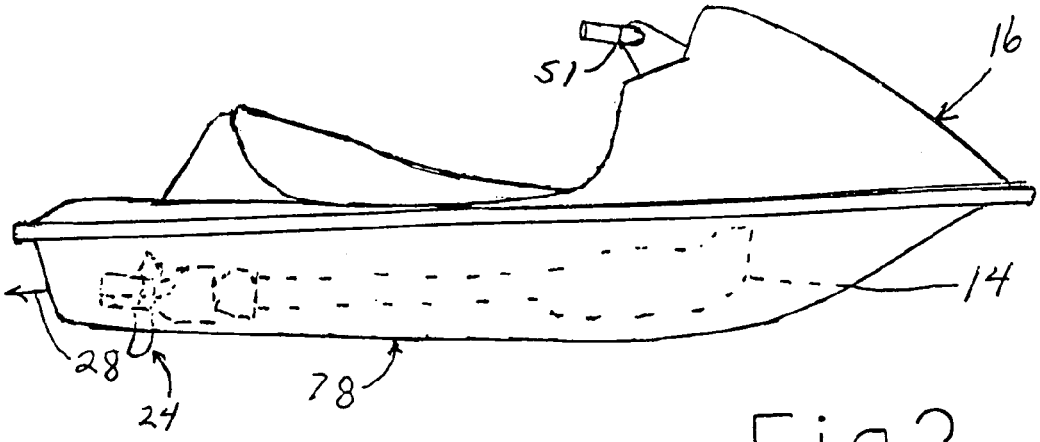
FIG. 2 is an elevational view of the rudder assembly of the invention shown mounted on a personal jet-powered watercraft as in FIG. 1 except depicting the rudder of the assembly out of the steering mode.
Figure 3:
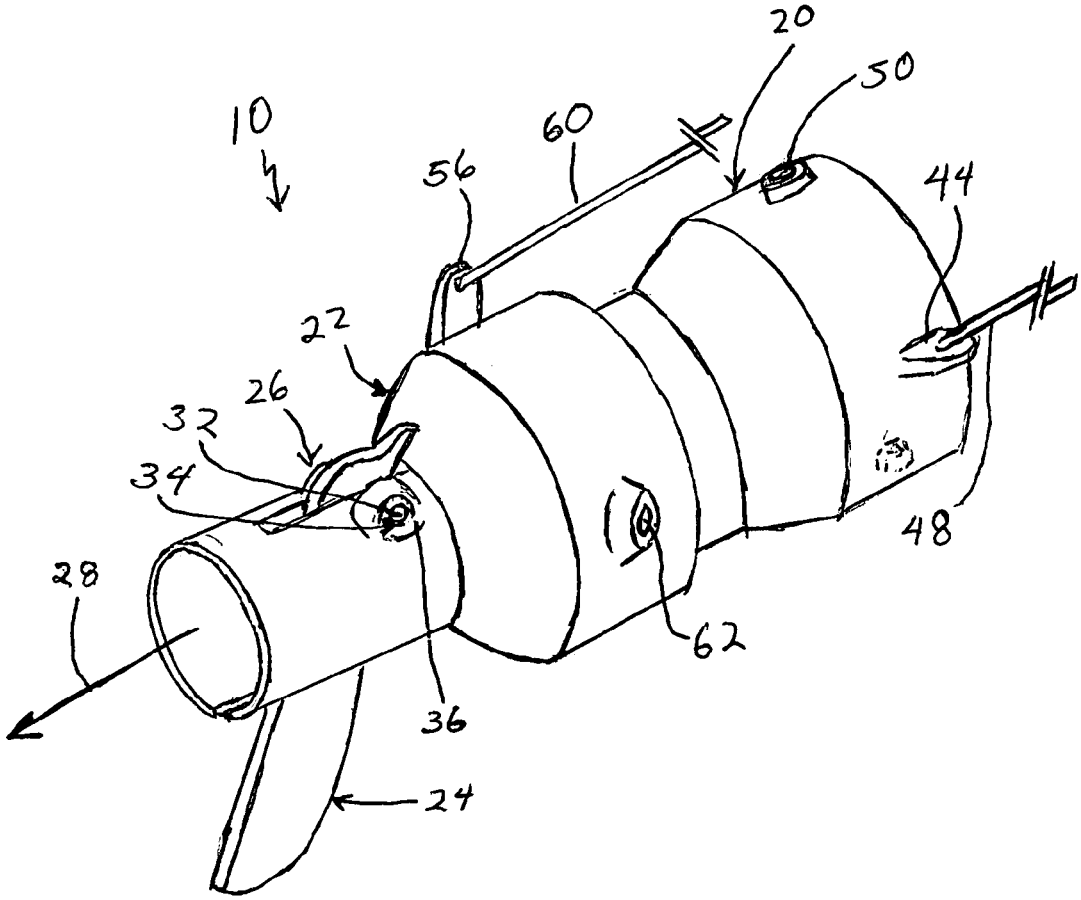
FIG. 3 is a perspective view of the rudder assembly of the invention depicting the rudder in the steering mode.
Figure 4:
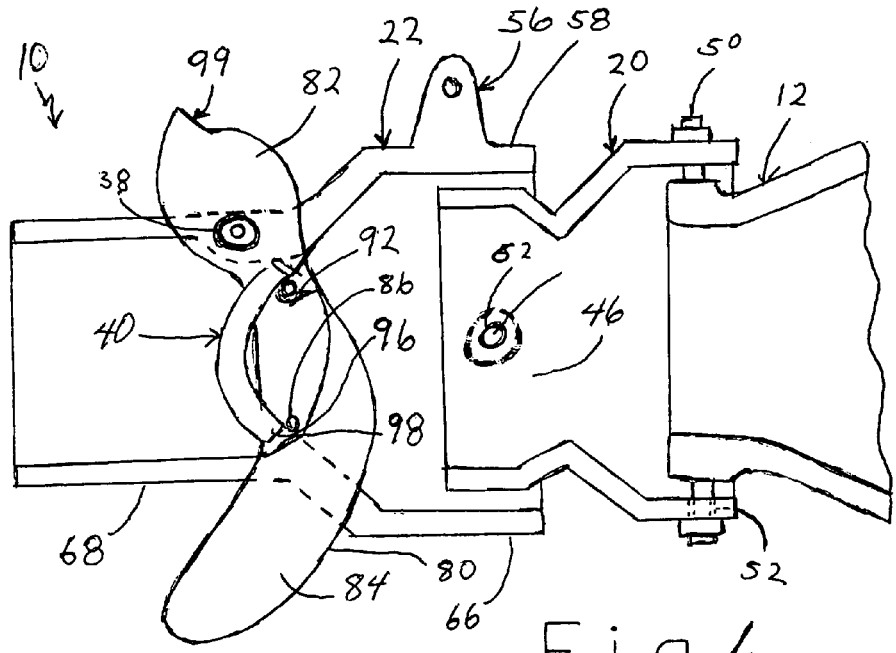
FIG. 4 is a longitudinal sectional view of the rudder assembly of the invention shown attached to the nozzle of the watercraft engine and depicting the rudder in the steering mode.
Figure 5:
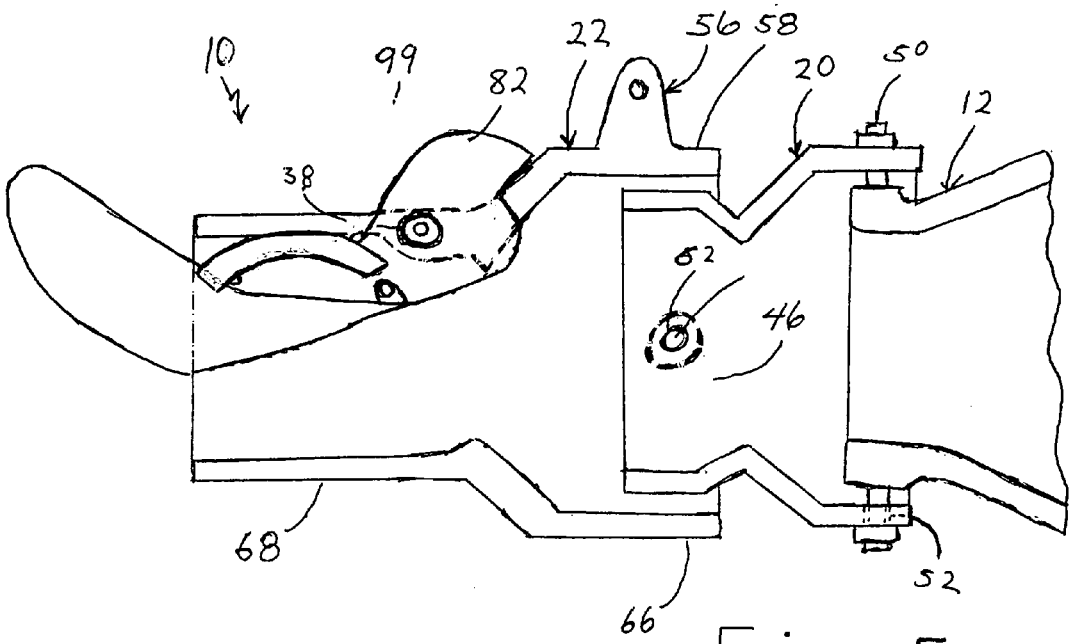
FIG. 5 is a longitudinal sectional view of the rudder assembly of the invention shown attached to the nozzle of the watercraft engine and depicting the rudder out of the steering mode.
Figure 6:
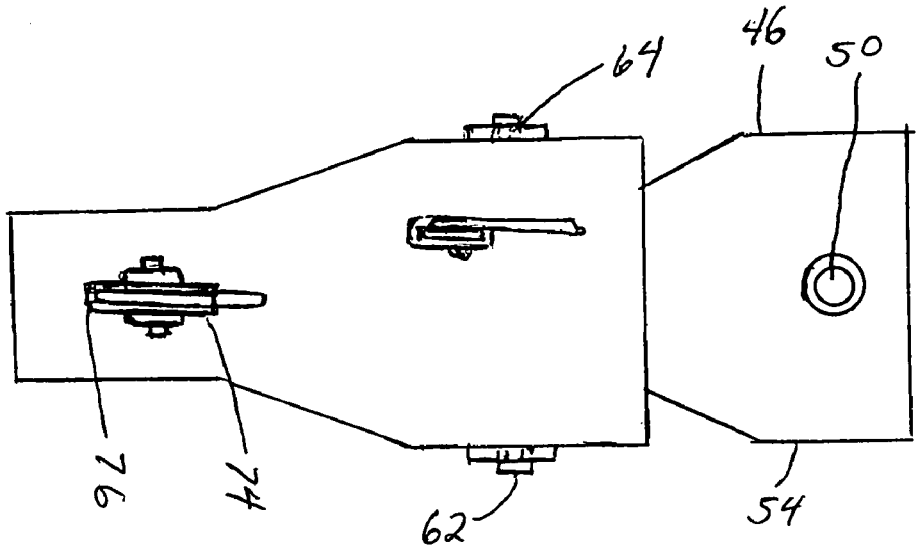
FIG. 6 is a top view of the rudder assembly of the invention.
Figure 7:
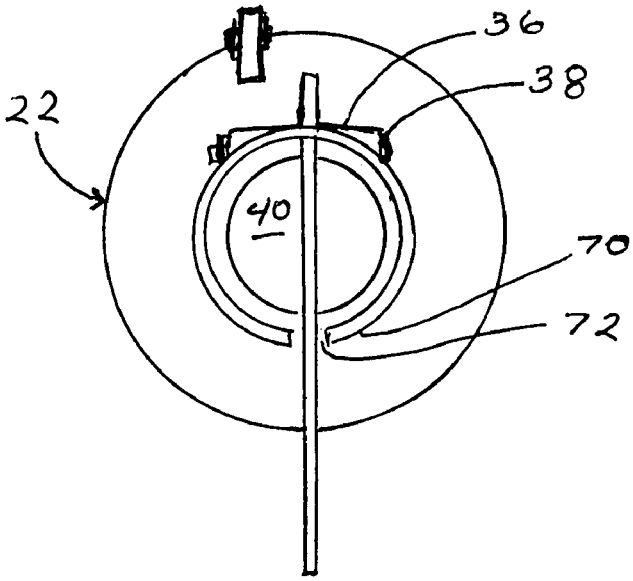
FIG. 7 is an end view of the rudder assembly of the invention.
Figure 8:
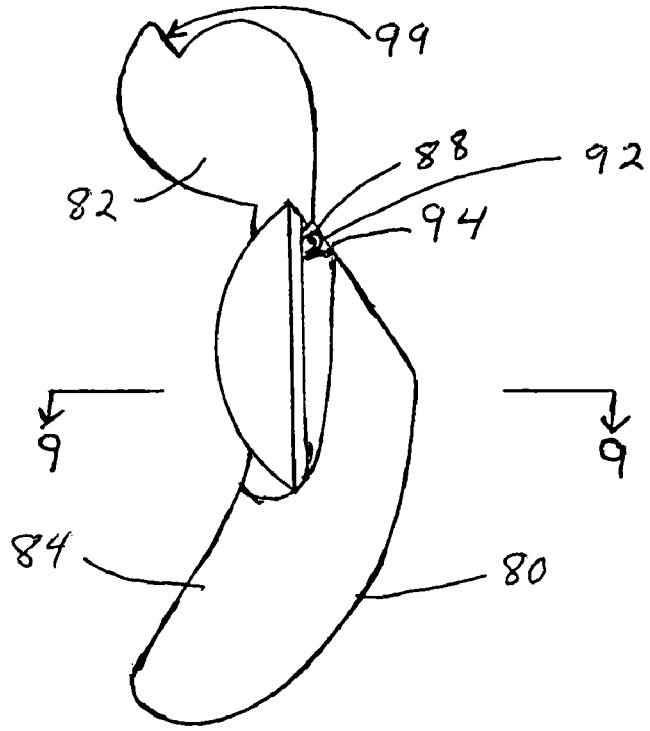
FIG. 8 is a side plan view of the rudder and cap components of the invention.
Figure 9:
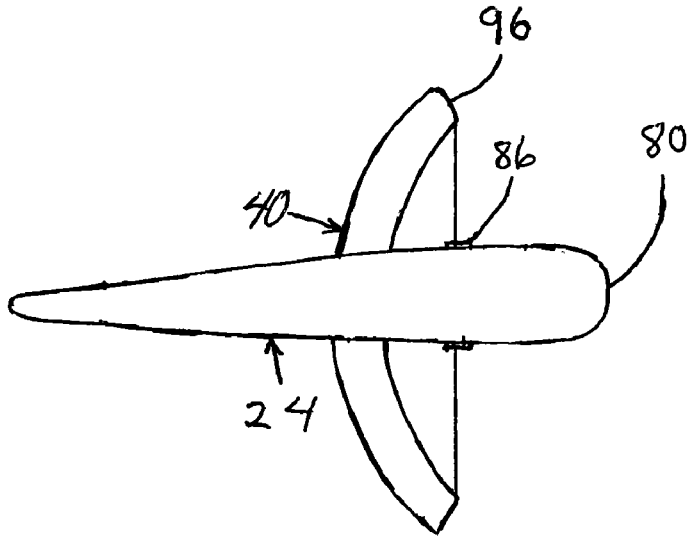
FIG. 9 is a cross-sectional view of the rudder and cap components of the invention taken along lines 9—9 of FIG. 8.

Referring to the drawings, the rudder assembly of the invention is generally designated by the numeral 10. The rudder assembly 10 is specifically designed to be attached to the nozzle 12 of a water jet engine 14 of a personal watercraft 16. The assembly 10 preferably includes an adapter component 18 which essentially adapts the nozzle 12 to receive the other components of the assembly and enable them to function in conjunction with the water jet engine 14. The adapter preferably includes an inner nozzle adapter 20 which attaches directly onto the nozzle 12 and an outer nozzle adapter 22 which attaches directly onto the inner nozzle adapter 20.

A rudder 24 is rotatably connected at a top portion of the outer nozzle adapter 22 via a hinge 26. The hinge enables the rudder to rotate from a position in which it is oriented so that it extends rearward to a position in which it is oriented downward. In the rearward position the rudder is approximately longitudinally aligned with the direction of flow of the jet stream 28 exiting from the outlet 30 of the outer nozzle adapter. In the downward position, the rudder is approximately perpendicular to the direction of flow of the jet stream 28.

The hinge 26 preferably includes a shaft 32 rotatably mounted in the bores 34 of the hinge body 36. A hinge spring 38 mounted on the shaft 32 biases the rudder so as to pull it to its downward oriented position. The spring 38 is preferably a torsion spring 38. Thus, in the absence of countervailing forces, the spring 38 retracts the rudder 24 so that it is in a downward extending position in the water beneath the watercraft 16. In this downward position, the rudder is able to deflect water that is passing alongside it due to the motion of the watercraft 16 and thus able to function as a rudder.

The assembly 10 also includes a cap 40 which is securely connected to the rudder 24 preferably at a medial portion 42 thereof. The cap 40 is preferably dimensioned to match the dimensions of the outlet 30 in order to block jet stream flow therefrom. When the rudder 24 is in the retracted position, the cap 40 is thus in a position in which it covers the outlet 30. During engine operation, the jet stream impinging on the cap exerts a force which tends to push the cap (and rudder) rearward resulting in rotation of the rudder back and up. The force of the jet stream thus rotates the rudder into the rearward extending position. In this rearward extending position the rudder is out of the water (in the area below the watercraft), but it is in the jet stream where it cannot be used to provide steering of the watercraft. The torsional force of the spring 38 is preferably equal to the force exerted by the jet stream at engine idle so that when the engine is above idle the jet stream force is sufficient to rotate the rudder (and cap) into its extended position. Thus, when the watercraft is in a throttle on position, the outlet 30 of the nozzle adapter is open allowing the jet stream to freely pass therethrough and the rudder 24 is out of its operational position. But, when the watercraft is in a throttle off position or the engine is off, the jet stream force (if any) is insufficient to push the cap and rotate the rudder so that the rudder is retracted by the spring into its downward position where it can be utilized to steer the watercraft.

A steering structure 44 at preferably the left lateral side 46 of the inner nozzle adapter 20 is used to connect the inner adapter 20 to appropriate steering linkage 48 and to the handlebars 51. The inner nozzle adapter 20 is preferably rotatably connected to the inner nozzle adapter by means of a pair of inner adapter axles 50 mounted in axle bores 52 located at the left side 46 and right side 54 of the inner nozzle adapter 20. The axles 48 thus enable lateral (horizontal) rotation of the inner nozzle adapter 20 relative to the watercraft 16. This enables the user to steer the craft via the steering linkage 48 and rudder 24. Advantageously, the same handlebar setup used to steer the watercraft 16 by alteration of the direction of jet stream flow is used to steer the watercraft by the rudder 24 through rotational movement of the entire nozzle adapter 18 in which the rudder is securely mounted.

The outer nozzle adapter 22 is provided with a trim structure 56 which is basically similar to the steering structure 44. The trim structure 56 is preferably mounted at the top 58 of the outer nozzle adapter 22 and is used to connect the outer nozzle adapter 22 to a manual control (not shown) via trim linkage 60. Outer axles 62 are preferably mounted in outer bores 64 in the outer nozzle adapter 22 at the top side 58 and bottom side 66 thereof. The axles 62 thus enable vertical rotation of the outer nozzle adapter 22 relative to the watercraft 16. This enables the user to trim the planing angle of the craft via the steering linkage 60. The inner nozzle adapter 20 is preferably provided with a groove 68 which extends circumferentially around its medial portion. The circumferential groove 68 is preferably v-shaped in cross-section so that it accommodates the rotational movement of the outer nozzle adapter 22 allowing further movement of the outer nozzle adapter 22 without coming into contact with the inner nozzle adapter 20 so as to provide the outer nozzle adapter 22 with a wider range of rotational movement.

The outer nozzle adapter 22 has an end portion (or shroud) 68 within which the rudder 24 is positioned. The end portion 68 preferably includes lower portions 70 which define a groove 72 and upper portions 74 which define a slot 76. The rudder 24 moves within the slot 76 and groove 72 so that they act as guides. The groove 72 also acts to improve steering response. The slot is located at a medial portion of the shroud 68 while the groove 72 extends to a medial portion of the shroud but is open at an end thereof.

The rudder 24 is preferably shaped so that it is curved rearward. It is also long relative to its width and it is generally wider at its leading edge 80 and approximately tear drop shaped in cross-section. This tear drop shape decreases turbulence. The rudder is also comprised of an upper member 82 and a lower member 84 interconnected by a connector pin 86 which is preferably a solid rivet. A lock pin 88 mounted at the upper portion 90 of the rudder 24 (and, more specifically, mounted in the upper member 82 and movably positioned within a lock pin channel 94 in the lower member 84) in conjunction with a lock pin torsion spring 92 interconnects these portions yet provides them with a limited degree of relative movement. The bifurcated rudder design enables the rudder to yield to striking or being struck by an object or person that may undesirably come in contact with it while the rudder is either extended or retracted. The rudder 24 also includes a stop 99 at its upper portion which comes in contact with the outer nozzle adapter 22 upon excessive rotational movement thereof.

The cap 40 is preferably curved so that it is convex i.e., central portion is more rearward that peripheral portions. The ends 96 of the cap 40 are angled toward the rear. The ends 96 are angled to mate with the seat 98 for the cap 40 which is similarly angled. The seat 98 is located at the outlet 30 of the outer nozzle member 22. There is preferably a small gap of approximately one-quarter of an inch between the cap ends 96 and the seat 98 when the rudder is in its retracted position. This allows a certain amount of jet stream to pass through the outlet even when the cap closes the outlet 30.

The nozzle adapter is dimensioned so that the rudder does extend rearward beyond the transom of the watercraft when in its extended position. In addition, these components are also dimensioned so that the rudder 24 extends approximately four inches below the ride plate 78 of the watercraft when in its retracted position.

The rudder 24 is preferably composed of plastic. The outer and inner nozzle adapters 20 and 22 are preferably composed of cast aluminum.

Accordingly, there has been provided, in accordance with the invention, a component accessory for a jet-powered single person watercraft which provides improved safety, maneuverability and stability. It is to be understood that all the terms used herein are descriptive rather than limiting. Although the invention has been described in conjunction with the specific embodiment set forth above, many alternative embodiments, modifications and variations will be apparent to those skilled in the art in light of the disclosure set forth herein. Accordingly, it is intended to include all such alternatives, embodiments, modifications and variations that fall within the spirit and scope of the invention as set forth in the claims hereinbelow.

What is claimed is:

1. A rudder assembly for a watercraft, comprising:

a nozzle adapter for rotatably mounting on a nozzle of the watercraft, said nozzle adapter having an outlet for allowing jet stream from an engine of the watercraft to pass therethrough;

a cap for opening and closing the outlet, said cap having ends rearwardly angled when said cap is positioned to close said outlet in order to guide the jet stream from said outlet rearwardly thereby minimizing turbulence of the jet stream passing between said cap and said outlet;

a rudder securely connected to said cap;

a hinge rotatably connecting said rudder to said nozzle adapter;

a steering structure connected to said nozzle adapter for steering of the watercraft via rotation of said nozzle adapter relative thereto.

2. The assembly of claim 1 wherein said outlet of said nozzle adapter has seats which are angled to mate with said ends of said cap in order to enhance guiding of the jet stream from said outlet and minimizing turbulence of the jet stream passing between said cap and said outlet.

3. The assembly of claim 1 further including a spring mounted on said hinge for exerting a force on said rudder and cap for automatic rotation thereof to close the outlet and rotate said rudder into a desired steering position.

4. The assembly of claim 3 wherein said spring has a select torsional force selected to be lower than jet stream forces from the engine of the watercraft exerted on said cap so that said jet stream forces are sufficient to rotate said cap and rudder out of its desired steering position below the watercraft when the engine is propelling the watercraft.

5. The assembly of claim 1 wherein said rudder is curved to minimize surface area thereof contacting jet stream when extending longitudinally with respect to the watercraft and not in its desired steering position when the engine is propelling the watercraft.

6. The assembly of claim 1 further including a pair of inner axles mounted on said nozzle adapter, said pair of inner axles allowing horizontal rotational movement of said nozzle adapter relative to the nozzle to provide steering capability to the watercraft via said steering structure.

7. The assembly of claim 1 wherein said rudder has a stop at an upper end portion thereof to limit upward rotational movement of said rudder.

8. The assembly of claim 1 wherein said cap is convex to facilitate opening of the outlet by force of jet stream from the engine of the watercraft.

9. The assembly of claim 1 wherein said nozzle adapter includes a seat which is angled at a forty-five degree angle relative to direction of the jet stream through said outer nozzle adapter and wherein said cap includes ends which are correspondingly angled at a forty-five angle relative to direction of the jet stream through said outer nozzle adapter to mate with the seat for minimizing turbulence of jet stream passing between said seat and said ends.

10. A rudder assembly for a watercraft, comprising:

an inner nozzle adapter for rotatably mounting on a nozzle of a watercraft, said inner nozzle adapter having a port for allowing jet stream from an engine of the watercraft to pass therethrough;

an outer nozzle adapter mounted on said inner end member, said outer nozzle adapter having an outlet;

a cap for opening and closing the outlet, said cap convex to facilitate opening of the outlet by force of jet stream from the engine of the watercraft, said cap having ends which are rearwardly angled when said cap is positioned to close said outlet in order to guide the jet stream from said outlet rearwardly thereby minimizing turbulence of the jet stream passing between said cap and said outlet and minimizing separation gap between said cap and said outlet;

a rudder connected to said cap;

a hinge rotatably connecting said rudder to said outer nozzle adapter;

a steering structure connected to said inner nozzle adapter for steering of the watercraft via rotation of said inner nozzle adapter relative thereto.

11. The assembly of claim 10 further including a spring mounted on said hinge for exerting a force on said rudder and cap for automatic rotation thereof so that the cap closes the outlet.

12. The assembly of claim 11 wherein said spring has a torsional force selected to be lower than jet stream force from the engine of the watercraft exerted on said cap so that said jet stream force is sufficient to rotate said cap and rudder into a position in which not in its desired steering position below the watercraft when the engine is propelling the watercraft.

13. The assembly of claim 9 wherein said rudder is curved to minimize surface area thereof in jet stream when rotated so that not in its desired steering position when the engine is propelling the watercraft.

14. The assembly of claim 10 further including an inner axle mounted on said inner nozzle adapter, said inner axle allowing horizontal rotational movement of said inner nozzle adapter relative to the nozzle to provide steering capability to the watercraft via said steering structure.

15. The assembly of claim 10 wherein said rudder has a stop at an upper end portion thereof to limit upward rotational movement of said rudder.

16. The assembly of claim 10 wherein said outer nozzle adapter includes a seat which is angled at a forty-five degree angle relative to direction of flow through said outer nozzle adapter and wherein said cap includes ends which are correspondingly angled at a forty-five angle relative to direction of flow through said outer nozzle adapter to mate with the seat for minimizing turbulence of jet stream passing between said seat and said ends.

17. A rudder assembly for a watercraft, comprising:

a nozzle adapter for rotatably mounting on a nozzle of the watercraft, said nozzle adapter having an outlet for allowing jet stream from an engine of the watercraft to pass therethrough;

a cap for opening and closing the outlet;

a rudder securely connected to said cap, said nozzle adapter having a groove at a lower portion thereof and a slot at an upper portion thereof for receiving an upper portion of said rudder and for receiving a lower portion of said rudder respectively for allowing said rudder to rotate to and from a position in which it is normal to direction of movement of the watercraft and a position in which it is in alignment with direction of movement of the watercraft and for guiding movement of said rudder within said nozzle adapter;

a hinge rotatably connecting said rudder to said nozzle adapter;

a steering structure connected to said nozzle adapter for steering of the watercraft via rotation of said nozzle adapter relative thereto.

18. The assembly of claim 17 wherein said slot is at a medial portion of said nozzle adapter and said groove extends to a medial portion of said nozzle adapter so that said rudder does not extend rearwardly beyond said nozzle adapter when said rudder is normal to direction of movement of the watercraft and thereby in a desired steering position.

19. A rudder assembly for a watercraft, comprising:

a nozzle adapter for rotatably mounting on a nozzle of the watercraft, said nozzle adapter having an outlet for allowing jet stream from an engine of the watercraft to pass therethrough;

a cap for opening and closing the outlet;

a rudder securely connected to said cap, said rudder including an upper member and a lower member interconnected by a connector pin and further including a lock pin and a pin spring mounted in said upper and lower members for providing a limited degree of movement of said upper member relative to said lower member;

a hinge rotatably connecting said rudder to said nozzle adapter;

a steering structure connected to said nozzle adapter for steering of the watercraft via rotation of said nozzle adapter relative thereto.

20. A rudder assembly for a watercraft, comprising:

an inner nozzle adapter for rotatably mounting on a nozzle of a watercraft, said inner nozzle adapter having a port for allowing jet stream from an engine of the watercraft to pass therethrough;

an outer nozzle adapter mounted on said inner end member, said outer nozzle adapter having an outlet and a groove at a lower portion thereof and a slot at an upper portion thereof for receiving an upper portion of said rudder and for receiving a lower portion of said rudder for allowing said rudder to rotate to and from a position in which it is normal to direction of movement of the watercraft and a position in which it is in alignment with direction of movement of the watercraft and for guiding movement of said rudder within said outer nozzle adapter;

a cap for opening and closing the outlet;

a rudder connected to said cap;

a hinge rotatably connecting said rudder to said outer nozzle adapter;

a steering structure connected to said inner nozzle adapter for steering of the watercraft via rotation of said inner nozzle adapter relative thereto.

21. A rudder assembly for a watercraft, comprising:

an inner nozzle adapter for rotatably mounting on a nozzle of a watercraft, said inner nozzle adapter having a port for allowing jet stream from an engine of the watercraft to pass therethrough;

an outer nozzle adapter mounted on said inner end member, said outer nozzle adapter having an outlet;

a cap for opening and closing the outlet;

a rudder connected to said cap;

a hinge rotatably connecting said rudder to said outer nozzle adapter;

a steering structure connected to said inner nozzle adapter for steering of the watercraft via rotation of said inner nozzle adapter relative thereto;

an outer axle mounted on said outer nozzle adapter, said outer axle allowing vertical rotational movement of said outer nozzle adapter relative to the nozzle to provide trim capability to the watercraft.

22. The assembly of claim 20 further including a trim structure connected to said outer nozzle adapter for trimming of the watercraft by rotation of said outer nozzle adapter.

23. The assembly of claim 20 wherein said inner end member is circumferentially grooved at a medial portion thereof to receive inner ends of said outer nozzle adapter during rotation of said outer nozzle adapter to enhance range of rotational capability thereof.

24. A rudder assembly for a watercraft, comprising:

an inner nozzle adapter for rotatably mounting on a nozzle of a watercraft, said inner nozzle adapter having a port for allowing jet stream from an engine of the watercraft to pass therethrough;

an outer nozzle adapter mounted on said inner end member, said outer nozzle adapter having an outlet;

a cap for opening and closing the outlet;

a rudder connected to said cap, said rudder including an upper member and a lower member interconnected by a connector pin and further including a lock pin and a pin spring mounted in said upper and lower members for providing a limited degree of movement of said upper member relative to said lower member;

a hinge rotatably connecting said rudder to said outer nozzle adapter;

a steering structure connected to said inner nozzle adapter for steering of the watercraft via rotation of said inner nozzle adapter relative thereto.

* * * * *